US010156370B2

(12) United States Patent
Maynard

(10) Patent No.: US 10,156,370 B2
(45) Date of Patent: Dec. 18, 2018

(54) AIR CONDITIONER DEBRIS CONE

(71) Applicant: SIZE REDUCTION SPECIALISTS CORP., East Lansing, MI (US)

(72) Inventor: Donald Maynard, East Lansing, MI (US)

( * ) Notice: Subject to any disclaimer, the term of this patent is extended or adjusted under 35 U.S.C. 154(b) by 191 days.

(21) Appl. No.: 14/811,180

(22) Filed: Jul. 28, 2015

(65) Prior Publication Data

US 2016/0025359 A1 Jan. 28, 2016

Related U.S. Application Data

(60) Provisional application No. 62/029,880, filed on Jul. 28, 2014.

(51) Int. Cl.
*F24F 1/58* (2011.01)

(52) U.S. Cl.
CPC ..... *F24F 1/58* (2013.01)

(58) Field of Classification Search
CPC ..... F24F 13/20; F24F 1/58; A47J 37/0786; B41J 29/13; A47G 27/0206
USPC ..... 150/165, 154; 244/1 R, 53 B; 261/30; 52/244, 3, 300, 79.5; 49/463; 210/452, 210/469, 806; 62/259.1; D23/286, 364, D23/412
See application file for complete search history.

(56) References Cited

U.S. PATENT DOCUMENTS 621,937 A * 3/1899 Niemann ..... B01D 2/111 210/409
2,111,724 A * 3/1938 Perner ..... A61J 9/08 215/11.6
2,271,709 A * 2/1942 Norris ..... F24F 6/06 261/30
3,280,473 A * 10/1966 Sullivan ..... F26B 9/006 34/218
3,941,697 A 3/1976 Johnson
4,025,435 A 5/1977 Shea
4,487,695 A 12/1984 Connolly
5,291,707 A 3/1994 McDonald
7,140,194 B1 * 11/2006 Miller ..... F24F 1/58 62/259.1
7,547,341 B2 * 6/2009 Sandberg ..... B01D 46/0005 55/491

(Continued)

FOREIGN PATENT DOCUMENTS

NL 1019582 C6 * 6/2003 ..... A47G 19/26

*Primary Examiner* — Fenn C Mathew
*Assistant Examiner* — Cynthia Collado
(74) *Attorney, Agent, or Firm* — Avery N. Goldstein; Blue Filament Law PLLC

(57) ABSTRACT

An air conditioning (A/C) cover is provided that includes a mesh material configured as a cone. The cone has a lower base circumference that is designed to cover an exhaust fan opening of an A/C unit. The cover can be formed from metal or plastic mesh. In some embodiments a breathable material on a frame is configured as a cone with a lower base circumference that is designed to cover an exhaust fan opening of an A/C unit. A process of protecting an exhaust fan from debris infiltration includes the provision of a flat sheet of a mesh material to an end-user with instructions how to form a cone from the mesh material and how to use fasteners to retain the shape of the cone; and coupling the cone to a housing around the exhaust fan.

22 Claims, 3 Drawing Sheets

(56) References Cited

U.S. PATENT DOCUMENTS

| | | | | |
|---|---|---|---|---|
| 8,052,083 | B1 * | 11/2011 | Moran | B64D 33/02<br>244/53 B |
| 2010/0270427 | A1 * | 10/2010 | Barrientos | B64D 33/02<br>244/1 R |
| 2014/0290762 | A1 * | 10/2014 | Gordon | E03C 1/0404<br>137/544 |

* cited by examiner

AIR CONDITIONER DEBRIS CONE

RELATED APPLICATIONS

This application is a non-provisional application that claims priority benefit of U.S. Provisional application Ser. No. 62/029,880 filed 28 Jul. 2014; the contents of which are hereby incorporated by reference.

FIELD OF THE INVENTION

The present invention in general relates to the field of air conditioning and in particular to a debris mesh cone configured for placement above an air conditioner exhaust fan.

BACKGROUND OF THE INVENTION

Air conditioning (A/C) units are generally exposed to the weather and other environmental elements as the A/C units are positioned outside the structure that is being cooled. The A/C unit is generally equipped with a large fan at the top to cool the unit, and the fan exhaust needs to be kept clear of debris. However, since the A/C units are positioned outside debris tend to build up such as leaves, pine needles, etc. When leaves or debris decay they give off acidic gases that eat at the A/C unit's copper tubing, and by making small holes in the tubing allow Freon to escape, causing the A/C unit compressor to fail. Furthermore, to prevent the rusting of parts moisture being trapped inside the A/C unit should be avoided. Trapped moisture is the main cause of failure to electronics, electrical connections, switches and metal parts. Therefore, it is important to extend the life of the A/C unit by covering the unit all year round, even when A/C is in use, without trapping moisture in the unit. Thus, a cover for an A/C unit needs to be breathable and not restrict airflow from the exhaust fan. FIG. 1 illustrates a flat mesh cover 10 that is attached to an A/C unit 12 over the exhaust fan 14. However, the flat nature of existing A/C unit covers allows debris to build up, become matted, and clog up the pours or mesh of the cover thereby restricting airflow and trapping moisture in the covered A/C unit.

Thus, there exists a need for an improved cover for A/C units, where the cover does not get clogged with debris.

SUMMARY OF THE INVENTION

An air conditioning (A/C) cover is provided that includes a mesh material configured as a cone. The cone has a lower base circumference that is designed to cover an exhaust fan opening of an A/C unit. The cover is attached to the A/C unit with at least one fastener of bungee cords, an elastic band, an adjustable band clamp, snap connectors, a plunger-type retainer, or a combination thereof. The cover can be formed from metal or plastic mesh. In some embodiments a breathable material on a frame is configured as a cone with a lower base circumference that is designed to cover an exhaust fan opening of an A/C unit.

A process of protecting an exhaust fan from debris infiltration includes the provision of a flat sheet of a mesh material to an end-user with instructions how to form a cone from the mesh material and how to use fasteners to retain the shape of the cone; and coupling the cone to a housing around the exhaust fan.

BRIEF DESCRIPTION OF THE DRAWINGS

The present invention is further detailed with respect to the following non-limiting specific embodiments of the present invention. The appended claims should not be construed as being limited to the specific devices so detailed.

DETAILED DESCRIPTION OF THE INVENTION

The present invention has utility as a cover for A/C units. Embodiments of the inventive cover prevent the buildup of debris on the units exhaust fan. The inventive cover is formed from a mesh that has a conical shape that deflects debris, and does not allow the debris to buildup on the cover. Embodiments of the inventive conical mesh cover may be formed from a metal or plastic screen material. In a separate embodiment, the inventive cover is formed from a breathable material on a conical frame. The lower circumference of the A/C cover cone is sized to cover the exhaust fan opening of the A/C unit. Embodiments of the inventive cover may be secured to an A/C unit with cable ties, twisted wire, bungee cords, an elastic band, an adjustable band clamp, snap connectors, or a combination thereof.

Figure 1:
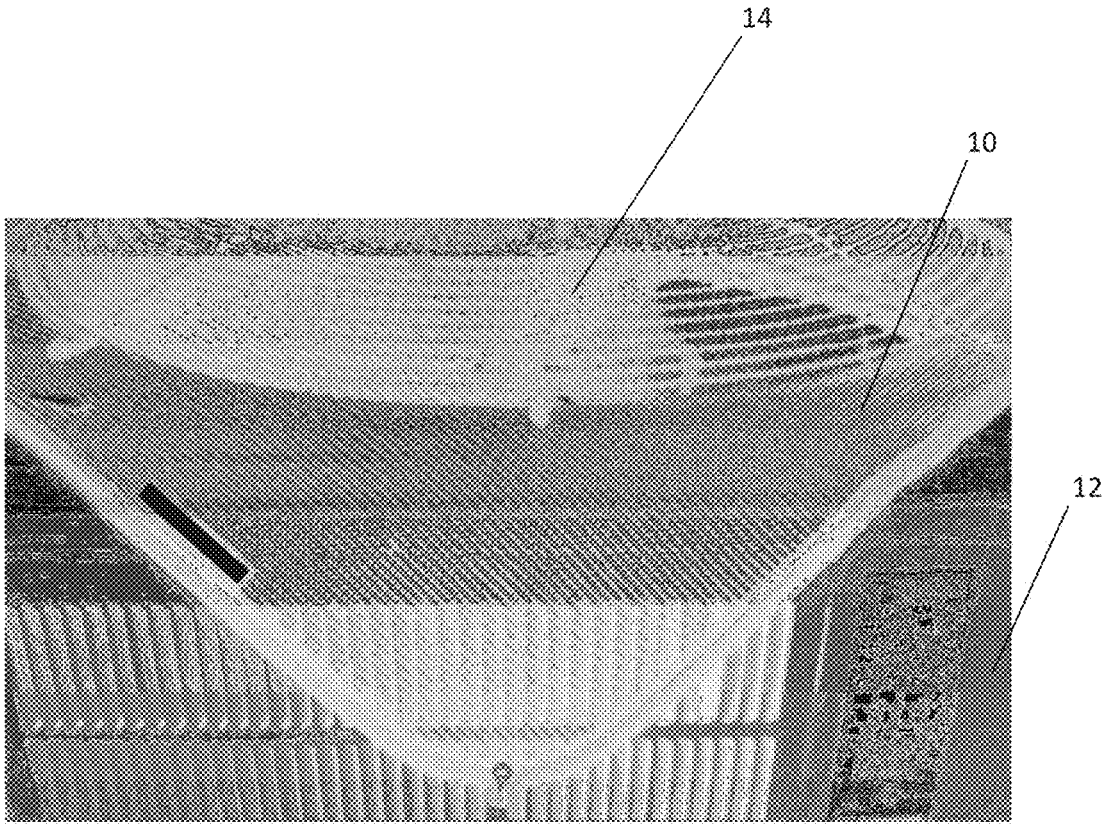
FIG. 1 (Prior Art)
FIG. 1 is a partial view of an existing flat mesh cover on an A/C unit.
Figure 2:
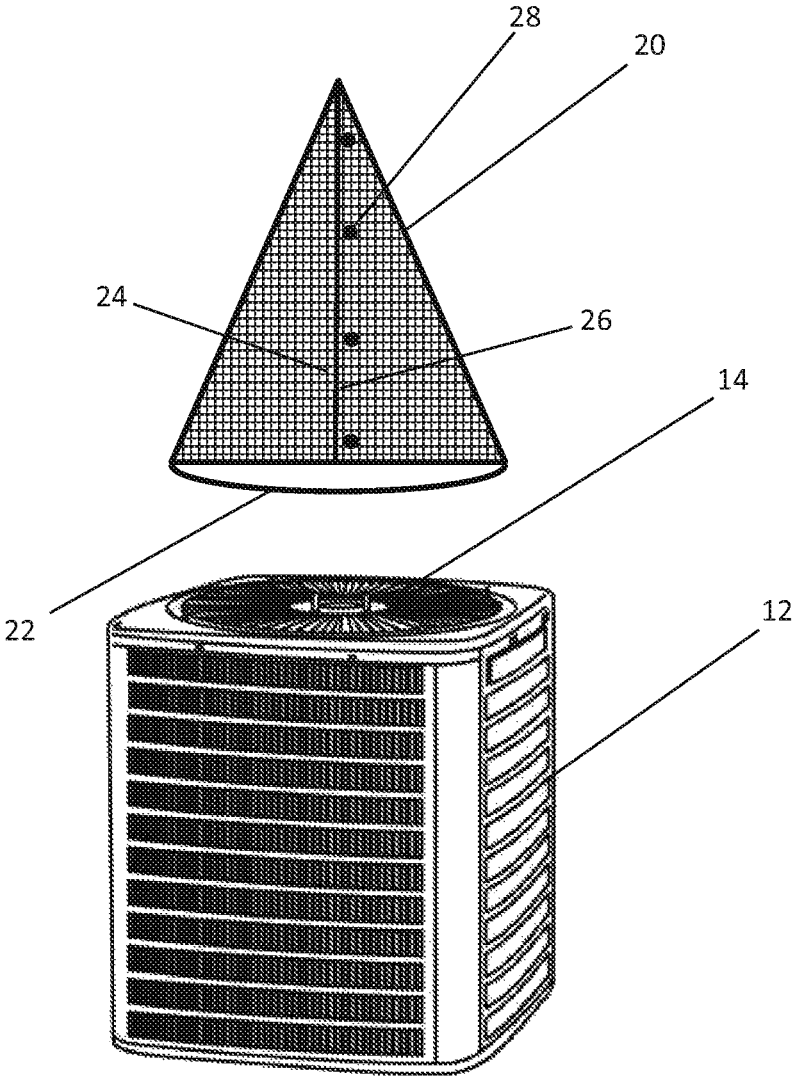
FIG. 2 is an exploded perspective view of a conical mesh cover and an A/C unit according to an embodiment of the invention.

With reference to the attached figures, FIG. 2 is an exploded perspective of a conical mesh cover 20 and an A/C unit 12 prior to attachment over the exhaust fan 14 according to an embodiment of the invention. As shown the lower base circumference 22 of the cover 20 is sized to cover the exhaust fan 14.

A conical mesh cover 20 is provided as a flat sheet of mesh material. Mesh materials operative herein illustratively include plastic, galvanized steel, and aluminum alloys. Custom installation of the cover 20 is readily accomplished with cable ties or twisted wire.

A process of protecting an exhaust fan from debris infiltration includes forming the cone 20 by bringing together edges 24, 26 of the mesh material to form a cone shape and using fasteners 28 such as ties or wire to retain the shape of the cone 20. It is appreciated that the cone is readily trimmed to remove excess as needed with shears. The base 22 of the cone 20 is readily secured to a housing of the A/C unit surround the exhaust fan 14 with resort to adhesive mounts to the A/C unit 12, the adhesive mounts defining an anchor point for a cable tie or wire that simultaneously engages the base 22 of the cone 20. Adhesive cable time mounts are commercially available including those from 3M under part number CTB1XBKA-C. Due to the open area and conical shape of the cover 20, an inventive device limits wind damage and clogging by debris, respectively.

Figure 3:
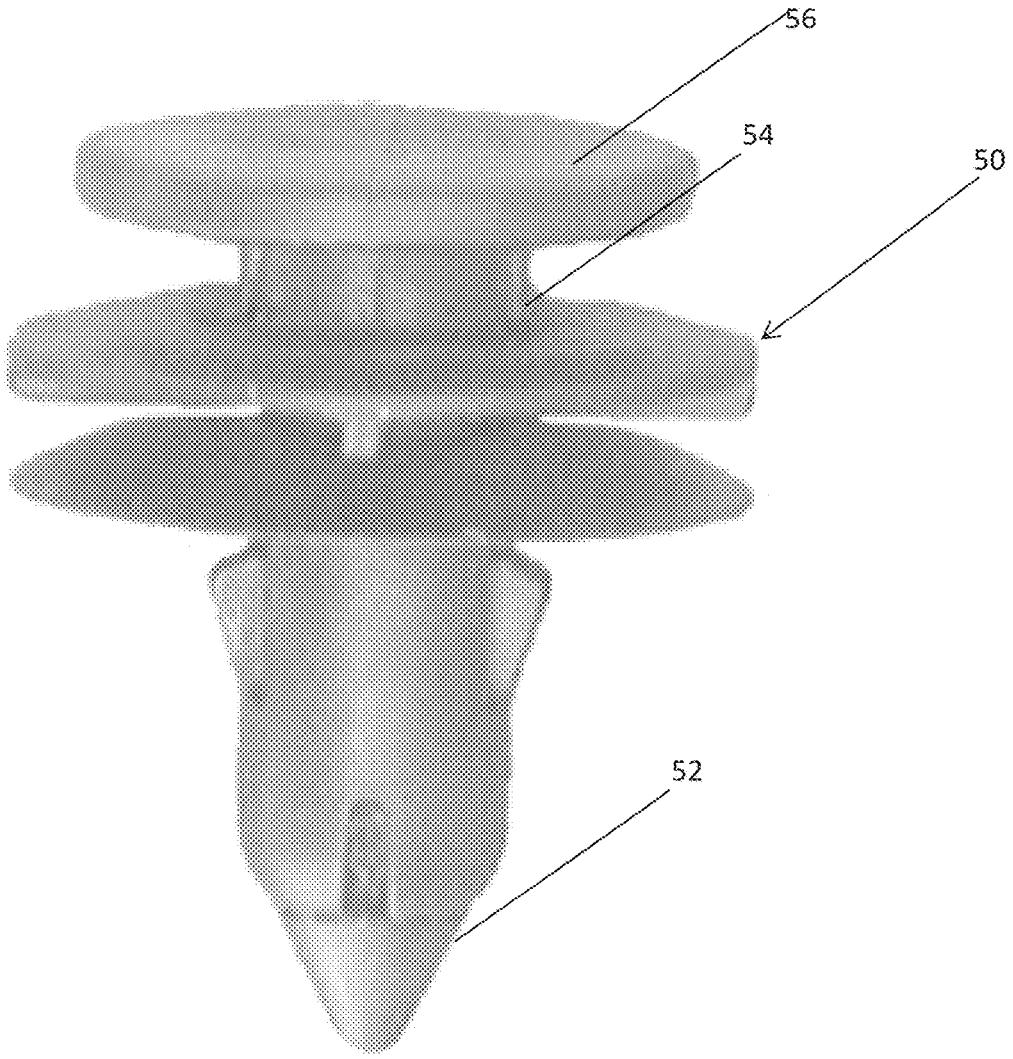
FIG. 3 PRIOR ART
FIG. 3 is a prior art view of a plunger-type retainer operative in the formation or retention of an inventive cover on an A/C unit.

An alternative fastener to retain the shape of the cone 20, secure the cone 20 to the A/C unit 12, or both is a plunger-type retainer commonly used to secure automotive trim. Exemplary of these plunger-type retainers is a door trim panel retainer Jeep Grand Cherokee 6505539-AA and shown in prior art FIG. 3 generally at 50. In operation, the retainer 50 shaft 52 is passed through a first opening in the mesh and a second opening in the mesh intended to be bound together and the barrel 54 of the retainer 50 is engaged to create a flair by pushing the cap 56 downward relative to the shaft 52. It is noted that this is readily accomplished without resort to tools in particular embodiments. A similar operation is employed to join the cone 20 to the A/C unit 12.

The foregoing description is illustrative of particular embodiments of the invention, but is not meant to be a limitation upon the practice thereof. The following claims, including all equivalents thereof, are intended to define the scope of the invention.

The invention claimed is:

1. An air conditioning cover comprising:

a flat mesh material having a first edge and a second edge, said mesh material being releasably configurable as a cone by joining the first edge and the second edge of said mesh material using at least one removable joining fastener, said cone having a lower base circumference that is designed to cover an exhaust fan opening of an A/C unit, said cone being releasably attachable to the A/C unit by at least one removable attaching fastener.

2. The cover of claim 1 wherein said cover is releasably attachable to said A/C unit with at least one removable attaching fastener of bungee cords, an elastic band, an adjustable band clamp, snap connectors, a plunger-type retainer, or a combination thereof.

3. The cover of claim 1 wherein said cover is releasably attachable to said A/C unit with at least one removable attaching fastener of cable ties or twisted wire.

4. The cover of claim 1 wherein said cover is releasably attachable to said A/C unit with at least one removable attaching fastener of plunger-type retainers.

5. The cover of claim 1 wherein said mesh material is formed from plastic.

6. An air conditioning cover comprising:

a plastic breathable material on a frame, said frame having a first edge and a second edge, said frame being releasably configurable as a cone by joining the first edge and the second edge of said frame using at least one removable joining fastener, said cone having a lower base circumference that is designed to cover an exhaust fan opening of an A/C unit, said cone being releasably attachable to the A/C unit by at least one removable attaching fastener.

7. The cover of claim 6 wherein said cover is releasably attachable to said A/C unit with at least one removable attaching fastener of bungee cords, an elastic band, an adjustable band clamp, snap connectors, plunger-type retainers, or a combination thereof.

8. The cover of claim 6 wherein said cover is releasably attachable to said A/C unit with at least one removable attaching fastener of cable ties or twisted wire.

9. The cover of claim 6 wherein said cover is releasably attachable to said A/C unit with at least one removable attaching fastener of plunger-type retainers.

10. The cover of claim 6 wherein said frame is formed from metal or plastic.

11. A process of protecting an exhaust fan from debris infiltration comprising:

providing an end-user with a flat sheet of a mesh material having a first edge and a second edge;

providing instruction for forming a cone from the flat sheet of mesh material;

providing instruction for releasably joining the first edge and the second edge of the mesh material using at least one removable joining fastener to retain the cone shape, said cone having a lower base circumference that is sized to cover an exhaust fan opening of an A/C unit; and providing instruction for releasably attaching said cone to a housing around the exhaust fan along the lower base circumference of the cone using at least on removable attaching fastener.

12. A process of protecting an exhaust fan from debris infiltration comprising:

providing an end-user with a flat sheet of a mesh material as a cone;

forming a cone from the mesh material;

providing instruction how to use fasteners that penetrate through at least two layers of the mesh material to retain a shape of said cone;

coupling said cone to a housing around the exhaust fan; and trimming said cone prior to joining said cone to said housing.

13. The cover of claim 1 wherein said mesh is formed from metal.

14. The cover of claim 1 wherein the first edge and the second edge of the mesh material are releasably joined together by removable joining fasteners that penetrate through at least two layers of the mesh material to retain a shape of said cone.

15. An air conditioning cover comprising:

a mesh material having a first edge and a second edge releasably joined together by at least one removable joining fastener such that the mesh material forms a cone, said cone having a lower base circumference that is designed to cover an exhaust fan opening of an A/C unit;

wherein said cover is releasably attachable to said A/C unit with at least one removable attaching fastener of a bungee cord, an elastic band, an adjustable band clamp, snap connectors, a plunger-type retainer, a cable tie, a twisted wire, or a combination thereof.

16. The cover of claim 1 wherein the at least one removable joining fastener is a cable tie, wire, a plunger-type retainer, or a combination thereof.

17. The cover of claim 6 wherein the at least one removable joining fastener is a cable tie, wire, a plunger-type retainer, or a combination thereof.

18. The process of claim 11 wherein the at least one removable joining fastener is a cable tie, wire, a plunger-type retainer, or a combination thereof.

19. The cover of claim 15 wherein the at least one removable joining fastener is a cable tie, wire, a plunger-type retainer, or a combination thereof.

20. The cover of claim 1 wherein said cone if releasably attachable to the A/C unit by at least one removable attaching fastener along the lower base circumference of the cone.

21. The process of claim 12 wherein the penetrating at least two layers of the mesh material to retain a shape of said cone is accomplished without a tool.

22. The process of claim 12 wherein the cover is configured to be stored flat when not in use.

* * * * *